United States Patent [19]

Weir et al.

[11] Patent Number: 4,571,263

[45] Date of Patent: Feb. 18, 1986

[54] RECOVERY OF GOLD FROM REFRACTORY AURIFEROUS IRON-CONTAINING SULPHIDIC CONCENTRATES

[75] Inventors: Donald R. Weir, Fort Saskatchewan; Roman M. Genik-Sas-Berezowsky, Edmonton, both of Canada

[73] Assignee: Sherritt Gordon Mines Limited, Toronto, Canada

[21] Appl. No.: 707,922

[22] Filed: Mar. 4, 1985

[30] Foreign Application Priority Data

Sep. 27, 1984 [CA] Canada ..... 464179

[51] Int. Cl.[4] ..... C22B 11/04

[52] U.S. Cl. ..... 75/101 R; 75/108; 75/115; 75/118 R; 423/27; 423/36; 423/41; 423/42; 423/45; 423/87; 423/146; 423/150; 423/158

[58] Field of Search ..... 75/101 R, 108, 115, 75/118 R; 423/27, 36, 41, 42, 45, 87, 146, 150, 158

[56] References Cited

U.S. PATENT DOCUMENTS

| | | | |
|---|---|---|---|
| 4,038,362 | 7/1977 | Guay | 423/29 |
| 4,266,972 | 5/1981 | Redondo-Abad et al. | 423/41 |
| 4,304,644 | 12/1981 | Victorovich et al. | 423/150 |

*Primary Examiner*—John Doll
*Assistant Examiner*—Robert L. Stoll
*Attorney, Agent, or Firm*—Robert F. Delbridge; Arne I. Fors

[57] ABSTRACT

A process for recovering gold from refractory auriferous iron-containing concentrate includes feeding the concentrate as an aqueous slurry to an acidic pretreatment step and treating the concentrate in the acidic pretreatment step with aqueous sulphuric acid solution to decompose carbonate and other acid consuming gangue compounds. The treated slurry is oxidized in a pressure oxidation step at a temperature in the range of from about 135° to about 250° C. under a pressurized oxidizing atmosphere while maintaining a free acid concentration of from about 5 to about 40 g/L sulphuric acid to cause dissolution of iron, formation of sulphuric acid and oxidation of substantially all oxidizable sulphide compounds to sulphate form with less than about 20% of oxidized sulphur being present as elemental sulphur during the oxidation step. Water is added to the oxidized slurry in a first repulping step to produce a repulped oxidized slurry with a pulp density in the range of from about 5 to about 15% solids by weight, the repulped oxidized slurry is subjected to a liquid-solids separation step to produce an acid and iron containing solution and oxidized separated solids, a portion of the acid and iron containing solution is recycled to the acidic pretreatment step, and gold is recovered from the oxidized separated solids.

11 Claims, 1 Drawing Figure

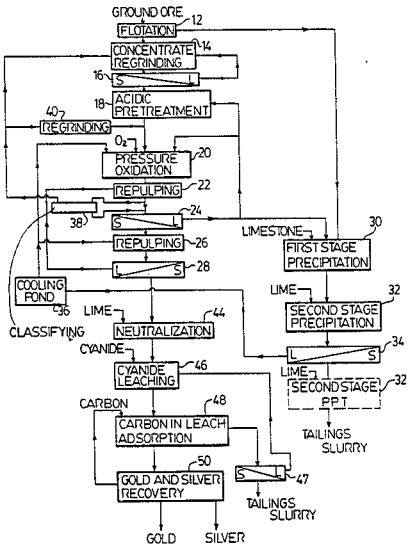

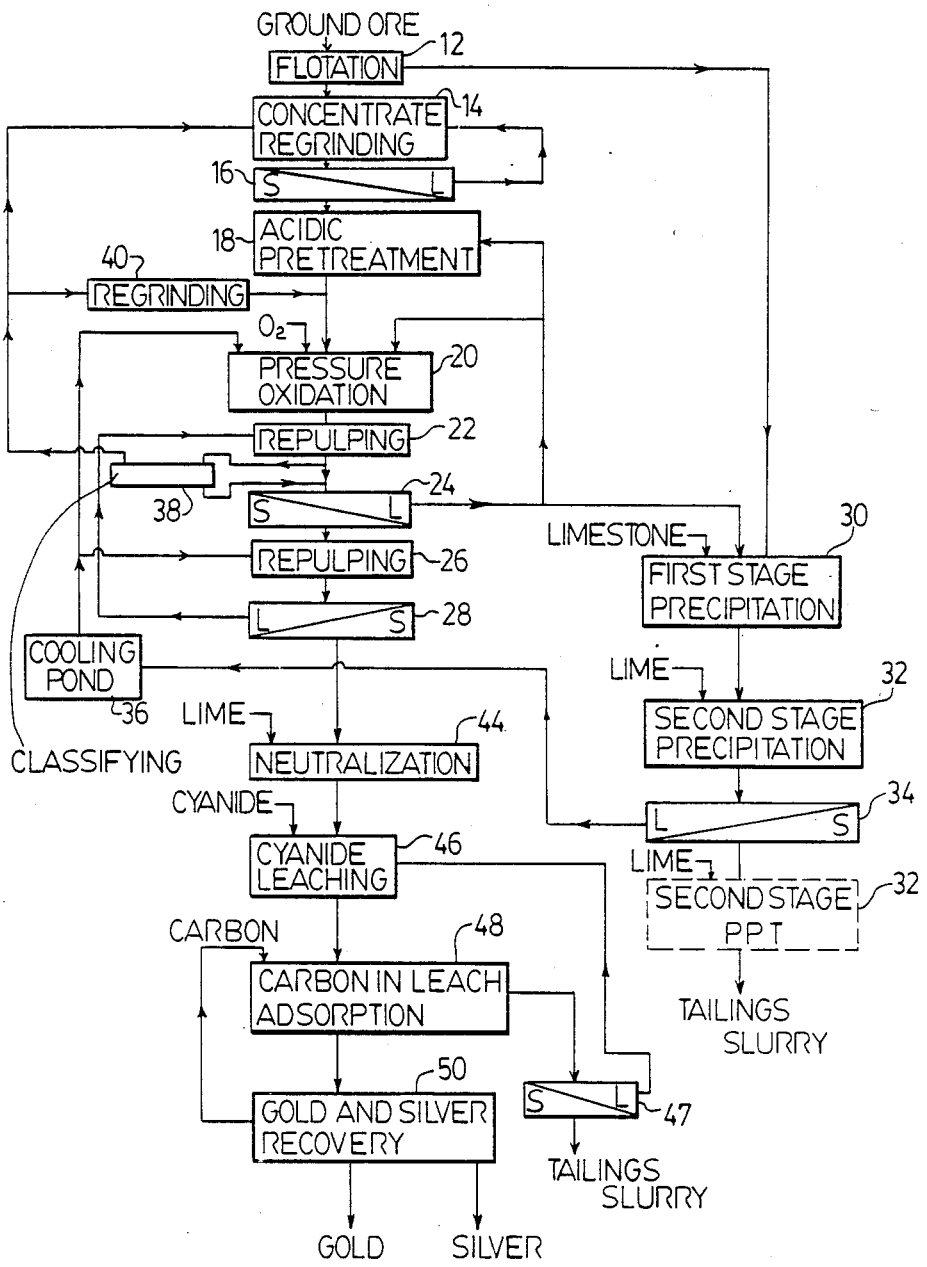
GROUND ORE
FLOTATION
12
CONCENTRATE REGRINDING
14
16
S
L
ACIDIC PRETREATMENT
18
40
REGRINDING
$O_2$
PRESSURE OXIDATION
20
REPULPING
22
24
38
S
L
LIMESTONE
30
REPULPING
26
FIRST STAGE PRECIPITATION
L
S
28
COOLING POND
36
LIME
32
SECOND STAGE PRECIPITATION
LIME
44
CLASSIFYING
NEUTRALIZATION
34
CYANIDE
L
S
CYANIDE LEACHING
46
LIME
SECOND STAGE PPT
32
CARBON
48
CARBON IN LEACH ADSORPTION
TAILINGS SLURRY
50
S
L
47
GOLD AND SILVER RECOVERY
TAILINGS SLURRY
GOLD
SILVER

RECOVERY OF GOLD FROM REFRACTORY AURIFEROUS IRON-CONTAINING SULPHIDIC CONCENTRATES

This invention relates to the recovery of gold and possibly other metal values from refractory auriferous sulphidic concentrates.

It is known that gold recovery from such concentrate by conventional processes such as cyanidation is not satisfactory, and various preliminary treatment processes have been proposed. However, for various reasons, the preliminary treatments in the prior art do not improve gold recovery proposed from such concentrate as much as is desirable in a commercial operation.

It is therefore an object of the present invention to provide an improved preliminary treatment process for such concentrates which includes pressure oxidation treatment.

The present invention provides a process for recovering gold from refractory auriferous iron-containing sulphidic concentrate comprising feeding the concentrate as an aqueous slurry to an acidic pretreatment step, treating the concentrate in the acidic pretreatment step with aqueous sulphuric acid solution to decompose carbonate and acid consuming gangue compounds which might otherwise inhibit a subsequent pressure oxidation step, oxidizing the treated slurry in a pressure oxidation step at a temperature in the range of from about 135° to about 250° C. under a pressurized oxidizing atmosphere while maintaining a free acid concentration of from about 5 to about 40 g/L sulphuric acid to cause dissolution of iron, formation of sulphuric acid and oxidation of substantially all oxidizable sulphide compounds to sulphate form with less than about 20% of oxidized sulphur being present as elemental sulphur during the oxidation step, adding water to the oxidized slurry in a first repulping step to produce a repulped oxidized slurry with a pulp density in the range of from about 5 to about 15% solids by weight, subjecting the repulped oxidized slurry to a liquid-solids separation step to produce an acid and iron containing solution and oxidized separated solids, recycling a portion of the acid and iron containing solution to the acidic pretreatment step, and removing gold from the oxidized separated solids. The process may include recycling a portion of the acid and iron containing solution to the oxidation step.

The process may also include adding a precipitating agent in a precipitation step to a portion of the acid and iron containing solution to precipitate metals as their respective hydroxides or hydrated oxides, sulphate ions as insoluble sulphate and arsenic as insoluble arsenate, separating the precipitates from the remaining aqueous solution, and utilizing at least some of the separated aqueous solution in the oxidation step. A portion of the separated aqueous solution may be added to the oxidized separated solids in a second repulping step to produce a second repulped oxidized slurry with a pulp density in the range of from about 5 to about 15% solids by weight, subjecting the second oxidized repulped slurry to a second liquid-solids separation step to produce a second acid and iron containing solution and second separated oxidized solids, and recycling at least a portion of the second acid and iron containing solution to the first repulping step. The refractory auriferous iron-containing sulphidic ore may be subjected to a flotation step to produce said concentrate and flotation tailings which may be useful as precipitating agent in said precipitation step.

The process may further include cooling the separated aqueous solution prior to utilization in the oxidation step. Advantageously, a sufficient amount of magnesium is maintained in the slurry in the pressure oxidation step to produce a Mg:Fe molar ratio in solution of from about 0.5:1 to about 10:1 to cause iron which is precipitated during the pressure oxidation step to tend to be precipitated as hematite rather than as other insoluble iron compounds. A precipitating agent may be added in a first precipitation step to a portion of the acid and iron containing solution to raise the pH to a value in the range of from about 5 to about 8.5 to precipitate desired dissolved values while causing magnesium ions to remain in solution, and recycling at least some of the magnesium containing solution to the oxidation step to provide magnesium ion therein. At least some of the slurry from the first repulping step may be subjected to a classification step to separate solids above a predetermined size from the remaining slurry, grinding the separated oversize solids to a smaller size, feeding the ground solids to at least one of the acidic pretreatment and pressure oxidation steps, and returning the remaining slurry to the step following the first repulping step.

Embodiments of the invention will now be described, by way of example, with reference to the accompanying drawing which shows a flowsheet of a process for the recovery of gold and other metal values from refractory auriferous sulphidic concentrate.

Referring to the drawing, refractory auriferous sulphidic concentrate which is treated in this embodiment contains from about 10 to about 800 g/t Au, from about 30 to about 300 g/t Ag, and by weight from about 10 to about 40% Fe, from about 5 to about 40% $SiO_2$, from about 10 to about 45% S, from about 0.1 to about 25% As, from about 0.01 to about 3% Sb, from about 0.1 to about 6% Al, from about 0.1 to about 5% Ca, from about 0.1 to about 10% $CO_2$, from about 0.1 to about 10% Mg and from less than 0.1 to about 8% C (organic).

The sulphidic content of such concentrate may comprise one or more of the following materials, namely pyrite, arsenopyrite, pyrrhotite, stibnite and sulphosalts, and the concentrate may also contain varying amounts of lead, zinc and copper sulphides. Also, some concentrate may contain oxidizable carbonaceous species.

Ore ground to at least about 70% minus 100 Tyler screen (less than 149 microns) is fed to a flotation step 12 to produce the previously mentioned concentrates together with flotation tailings. The concentrate is reground in an optional regrinding step 14 with water from a subsequent liquid-solids separation step 16 to about 96% minus 325 Tyler screen (less than 44 microns).

Concentrate slurry from the separation step 16 with a pulp density of from about 40 to 80% solids by weight proceeds to an acidic pretreatment step 18 where the slurry is repulped with acidic wash solution obtained by washing solids from the pressure oxidation step which will be described later. Such acidic wash solution will generally contain iron, aluminum, magnesium, arsenic and other nonferrous metal values dissolved in the pressure oxidation as well as sulphuric acid. The acidic pretreatment decomposes carbonates and acid consuming gangue components which might otherwise inhibit the pressure oxidation step. The acidic pretreatment step 18 thus also reduces acid consumption in the subsequent pressure oxidation step and lime consumption in a neutralization step which will be described later. It will also be noted that the pretreatment step 18 utilizes acid produced in situ in the subsequent pressure oxidation step.

The treated slurry may be further treated by the addition of a lignosulphonate chosen from the group of calcium, sodium, potassium and ammonium lignosulphonate, prior to oxidation at a level 0.1 to 10 Kg/t of concentrate.

The pretreated slurry from a pretreatment step 18 proceeds directly to pressure oxidation step 20 where the slurry is treated in one or more multicompartment autoclaves at a temperature of from about 160° to about 200° C. and into which oxygen is sparged to maintain a total pressure of from about 700 to about 5,000 kPa, with acidity of 5 to 40 g/L $H_2SO_4$ to oxidize the sulphur, arsenic and antimony minerals. It is especially important to oxidize the sulphides to an oxidation step higher than free sulphur, since the presence of free sulphur is detrimental to gold recovery. In such oxidation, iron is the effective oxygen transfer agent. It is therefore necessary that adequate iron be present in solution, particularly in the initial compartments of the autoclave, this being achieved by ensuring a sufficiently high steady state acidity.

Additionally, the autoclave acidity and temperature are controlled such that the desired liberation of gold is achieved by oxidation of the sulphides, arsenides and antimonial compounds to a higher oxidation stage, and at the same time the physical characteristics of the solids produced are such that subsequent thickening and washing is facilitated. Acidity and temperature can be controlled by recycling acidic wash solution and cooling pond water, as will be described in more detail later, to appropriate autoclave compartments.

The pressure oxidation of pyrite results in the generation of ferric sulphate and sulphuric acid. Some of the ferric sulphate is hydrolyzed and may be precipitated as hematite, ferric arsenate, hydronium jarosite, basic ferric sulphate or a mixture of these compounds. The nature of the precipitated iron species depends on such parameters as temperature, total sulphate levels, acidity, pulp density, grade of concentrate and the nature and quantity of acid consuming gangue. The pressure oxidation of high grade pyrite and/or arsenopyrite feeds at high solids contents in the pulp generally favours precipitation of the iron as basic ferric sulphate, hydronium jarosite or ferric arsenate.

According to a further feature of the invention, it has been found that it is desirable (for reducing lime requirements in a neutralization step prior to cyanidation) that dissolved iron which becomes hydrolyzed and precipitated in pressure oxidation step 20 be precipitated as hematite rather than as basic ferric sulphate or hydronium jarosite, and further that such hematite precipitation can be promoted by maintaining a sufficiently high concentration of magnesium in the pressure oxidation step.

With the process of the present invention, it has been found that hematite is the preferred form of iron precipitate in the pressure oxidation step 20, in that it results in a better release of acid in pressure oxidation step 20 which is readily removed by limestone in a first stage precipitation step which will be described later, thus reducing lime requirements in the cyanidation circuit. Also, the precipitation of iron as basic ferric sulphate and/or a hydronium jarosite is undesirable for two reasons. Firstly, a greater portion of labile sulphate (which is a potential lime consumer) enters a subsequent neutralization step resulting in a higher consumption of lime. Secondly, the reaction of lime with basic ferric sulphate and jarosites, with conversion of the iron precipitate to insoluble iron hydroxides and gypsum, results in the generation of slimy precipitates, increases the solids content and results in an increased loss of gold and silver to the slimes by adsorption.

Thus, it has been found that there should be a sufficient amount of magnesium in the pressure oxidation step 20 to produce an Mg:Fe molar ratio in the solution of at least about 0.5:1.0 and preferably at least about 1:1. Many auriferous pyrite ores contain appreciable levels of acid soluble magnesium which may meet at least part of such magnesium repuirements. In many instances however, the gold and sulphidic content of the ore is upgraded by flotation step 12, thereby reducing the magnesium content of the concentrate to the oxidation step 20. The magnesium requirements of the pressure oxidation step 20 may be provided at least in part by the previously mentioned recycles of acidic wash solution and cooling pond water (to which macnesium ions may be added in a manner as will be described later).

After a suitable retention time in the pressure oxidation autoclave, for example about 1.5 hours, the oxidized slurry is repulped with solution from a later liquid-solids separation step 28 to dilute the slurry to less than 10% solids by weight so as to obtain efficient use of flocculant which is added in repulping step 22. Solids from separation step 24 proceed to a second repulping step 26 where cooling pond water is added to form a slurry of again less than 15% by weight. The repulped slurry thus proceeds to separation step 28 from which solution is recycle to repulping step 22 as previously mentioned. The treatment of the solids from separation step 28 will be described later.

Solution from separation step 24 contains acid and dissolved iron and non-ferrous metal sulphates. Some of this solution is recycled to acidic pretreatment step 18 and pressure oxidation step 20 as previously mentioned, and the remaining solution proceeds to a first stage precipitation step 30 where limestone is added to raise the pH to about 5 and precipitate metal values such as ferric iron, aluminum and arsenic as well as removing sulphate sulphur as gypsum. Flotation tailings from flotation step 12 may be used in this precipitation step. The slurry then passes to a second stage precipitation step 32 where lime is added to raise the pH to about 10 to precipitate magnesium and other metal values. The resultant slurry is passed to liquid-solids separation step 34 from which relatively pure separated water proceeds to cooling pond 36 for subsequent use in pressure oxidation step 20 and repulping step 26 as previously described. The solids from separation step 34 can be disposed of as tailings.

If desired, the second stage precipitation step 32 may be located after the separation step 34 (as indicated in dotted outline in the drawing) so that the water supplied to the cooling pond and subsequently to the pressure oxidation step 20 and repulping step 26 contains magnesium ions which assist in maintaining the previously mentioned desirable dissolved magnesium concentrations in the pressure oxidation step 20.

Also, if desired, a portion of the repulped slurry from the repulping step 22 may be passed through a classifier 38 (such as a cyclone) before passing to the separation step 24. The classifier 38 removes a preselected oversize material some of which is recycled to regrinding step 14 and some of which is reground in regrinding step 40 and passed to pressure oxidation step 20. Such a feature enables gold to be recovered which might otherwise have been lost in relatively oversize material whose treatment had not been satisfactorily completed in the pressure oxidation step 20.

Solids from the separation step 28 pass to neutralization step 44 where lime is added to raise the pH to an extent suitable for cyanidation, preferably about 10.5. Water from a later liquid-solids separation step 47 is added to achieve the desired pulp density for cyanidation, namely about 40 to about 45% solids by weight.

The neutralized slurry thus proceeds to a two stage cyanidation step 46, with cyanide solution being added to the first stage. The partly leached pulp (60 to 95% leached) cascades into an eight stage carbon-in-leach adsorption section 48 to complete the leaching and recover dissolved gold and silver. After the eighth stage, the barren slurry is passed to liquid-solids separation step 47 with the liquid being recycled to cyanidation step 46 as previously mentioned and the solids being discarded as tailings. The loaded carbon passes to a metals recovery step 50 where loaded carbon is stripped under pressure with caustic cyanide solution, and gold and silver are subsequently recovered by electrowinning or other suitable means from the eluate. Stripped carbon is regenerated in a kiln, screened and recycled to the carbon-in-leach adsorption step 48.

EXAMPLE

The feed material was a refractory auriferous concentrate, containing pyrite and arsenopyrite as the major sulphide minerals. The chemical composition of the concentrate was 236 g/t Au, 0.1% Sb, 7.0% As, 4.2% $CO_2$, 24.7% Fe, 21.8% $SiO_2$ and 19.3% S. Conventional cyanidation extracted 74% of the gold, yielding a residue containing 60 g/t Au.

The concentrate was processed in a continuous circuit which consisted of an oxidation feed slurry preparation tank, feed pumping system, a four compartment autoclave having a static volume of 10 L, an autoclave discharge system, an oxidation thickener feed tank, an oxidation thickener, and a countercurrent decantation wash circuit comprising two thickeners and their respective feed tanks. The continuous circuit also contained a gold recovery section where gold was dissolved from the oxidized solids by cyanidation and adsorbed onto carbon, and a precipitation section where waste acidic solution was treated with limestone and lime to precipitate arsenic, metals and associated sulphate as arsenates, metal hydroxides or hydrated oxides, and gypsum, for recycle of the metals depleted solution to the oxidation and wash circuits.

The concentrate, as a 72% slurry of solids in water, was pretreated and diluted to 38% solids with acidic oxidation thickener overflow solution in the feed preparation tank, The acidic solution, containing 2.9 g/L As, 14.9% g/L Fe (total), 2.4 g/L Fe (ferrous) and 26.1 g/L $H_2SO_4$ was supplied at a rate sufficient to provide an equivalent of 100 kg acid per tonne of concentrate, to decompose the carbonates prior to autoclaving. A lignosulphonate was also supplied to the feed slurry, at a level of 1 kg/t concentrate. The pretreated slurry was pumped into the first compartment of the autoclave. Water was also fed to the first compartment for temperature control, diluting the solids content of the oxidation slurry to 16.7%. Oxygen was sparged into all compartments. The oxidation was conducted at 185° C. and the working pressure was controlled at 1850 kPa. The nominal retention time of the solids in the autoclave was 2.6 hours.

Samples were collected from the individual compartments to provide a measure of the oxidation of sulphur and liberation of gold, as determined by cyanide amenability testing of the sample of oxidized solids. Representative autoclave solution compositions, the extent of sulphur oxidation to the sulphate form, and gold extractability data obtained under these continuous pressure oxidation conditions are tabulated below:

| | Solution analyses, g/L | | | | % | Cyanidation | |
|---|---|---|---|---|---|---|---|
| Sample point | As | Fe | $Fe^{2+}$ | $H_2SO_4$ | Sulphur oxidation | Residue g/t Au | Extraction % Au |
| Treated feed | <0.1 | 5.0 | 5.0 | * | 0 | 63.3 | 73.2 |
| Compartment 1 | 0.8 | 4.1 | 1.7 | 25.5 | 68 | 16.4 | 93.1 |
| Compartment 2 | 0.6 | 4.2 | 1.0 | 32.3 | 87 | 9.19 | 96.1 |
| Compartment 3 | 0.8 | 9.2 | 1.0 | 33.3 | 93 | 6.14 | 97.4 |
| Compartment 4 | 0.8 | 11.1 | 0.9 | 33.8 | 95 | 3.62 | 98.5 |

*pH = 3.6

The autoclave discharge slurry was passed through a flash tank, into the oxidation thickener feed tank, where it was diluted to about 9% solids, and fed to the oxidation thickener. A portion of the oxidation thickener overflow solution was recycled to the concentrate feed pretreatment tank described earlier, while the remainder was treated with limestone, then lime, in the precipitation circuit to provide metals barren water for the wash circuit. The oxidation thickener underflow, containing 48% solids was subjected to two stages of washing in the CCD circuit to remove the bulk of the acidic oxidation liquor. The second wash thickener underflow, containing 53% solids was processed by conventional methods for the recovery of the gold.

Other embodiments and examples of the invention will be readily apparent to a person skilled in the art, the scope of the invention being defined in the appended claims.

What we claim as new and desire to protect by Letters Patent of the United States is:

1. A process for recovering gold from refractory auriferous iron-containing concentrate comprising:

feeding the concentrate as an aqueous slurry to an acidic pretreatment step, treating the concentrate in the acidic pretreatment step with aqueous sulphuric acid solution to decompose carbonate and other acid consuming gangue compounds, oxidizing the treated slurry in a pressure oxidation step at a temperature in the range of from about 135° to about 250° C. under a pressurized oxidizing atmosphere while manintaing a free acid concentration of from about 5 to about 40 g/L sulphuric acid to cause dissolution of iron, formation of sulphuric acid and oxidation of substantially all oxidizable sulphide compounds to sulphate form with less than about 20% of oxidized sulphur being present as elemental sulphur during the oxidation step, adding water to the oxidized slurry in a first repulping step to produce a repulped oxidized slurry with a pulp density in the range of from about 5 to about 15% solids by weight, subjecting the repulped oxidized slurry to a liquid-solids separation step to produce an acid and iron containing solution and oxidized separated solids, recycling a portion of the acid and iron containing solution to the acidic pretreatment step, and recovering gold from the oxidized separated solids.

2. A process according to claim 1 including recycling a portion of the acid and iron containing solution to the oxidation step.

3. A process according to claim 1 including adding a precipitating agent in a precipitation step to a portion of the acid and iron containing solution to precipitate metals as their respective hydroxides or hydrated oxides, sulphate ions as insoluble sulphate and arsenic as insoluble arsenate, separating the precipitates from the remaining aqueous solution and utilizing at least some of the separated aqueous solution in the oxidation step.

4. A process according to claim 3 including cooling the separated aqueous solution prior to utilization in the oxidation step.

5. A process according to claim 1 including maintaining a sufficient amount of magnesium ions in the slurry in the pressure oxidation step to produce a Mg:Fe molar ratio in solution of from about 0.5:1 to about 10:1 to cause iron which is precipitated during the pressure oxidation step to tend to be precipitated as hematite rather than as other insoluble iron compounds.

6. A process according to claim 5 including adding a precipitating agent in a first precipitating step to a portion of the acid and iron containing solution to raise the pH to a value in the range of from about 5 to about 8.5 to precipitate desired dissolved values while causing magnesium ions to remain in solution, and recycling at least some of the magnesium containing solution to the oxidation step to provide magnesium ions therein.

7. A process according to claim 3 including adding a portion of the separated aqueous solution to the oxidized separated solids in a second repulping step to produce a second repulped oxidized slurry with a pulp density in the range of from about 5 to about 15% solids by weight, subjecting the second oxidized repulped slurry to a second liquid-solids separation step to produce a second acid and iron containing solution and second separated oxidized solids, and recycling at least a portion of the second acid and iron containing solution to the first repulping step.

8. A process according to claim 1 including subjecting at least some of the slurry from the first repulping step to a classification step to separate solids above a predetermined size from the remaining slurry, grinding the separated oversize solids to a smaller size, feeding the ground solids to at least one of the acidic pretreatment and pressure oxidation steps, and returning the remaining slurry to the step following the first repulping step.

9. A process according to claim 3 including subjecting refractory auriferous iron-containing sulphidic ore to a flotation step to produce said concentrate and flotation tailings, and utilizing at least a portion of the flotation tailings as precipitating agent in said precipitation step.

10. A process according to claim 1 wherein the treated slurry is oxidized at a temperature in the range of from about 160° to about 200° C.

11. A process according to claim 1 wherein the treated slurry is further treated by the addition of a lignosulphonate, chosen from the group of calcium, sodium, potassium and ammonium lignosulphonate, prior to oxidation at a level 0.1 to 10 Kg/t of concentrate.

* * * * *